United States Patent [19]

Dean

[11] 4,144,683

[45] Mar. 20, 1979

[54] BRACKET ASSEMBLY

[75] Inventor: Robert O. Dean, Solvang, Calif.

[73] Assignee: Spiral-Craft, Owosso, Mich.

[21] Appl. No.: 812,760

[22] Filed: Jul. 5, 1977

[51] Int. Cl.[2] ..... E04B 1/38

[52] U.S. Cl. ..... 52/182; 52/713; 248/248; 248/300

[58] Field of Search ..... 52/182, 184, 191, 185, 52/713; 248/247, 248, 274, 298, 300

[56] References Cited

U.S. PATENT DOCUMENTS

| | | | |
|---|---|---|---|
| 1,657,243 | 1/1928 | Daniels | 248/300 X |
| 2,321,916 | 6/1943 | Ingerman | 248/248 |
| 2,709,494 | 5/1955 | Luce | 248/300 X |
| 2,911,690 | 11/1959 | Sanford | 248/300 X |
| 3,620,376 | 11/1971 | Gingher | 248/300 X |
| 3,730,464 | 5/1973 | Kelly | 248/300 |

*Primary Examiner*—J. Karl Bell
*Attorney, Agent, or Firm*—Gifford, Chandler, Van Ophem, Sheridan & Sprinkle

[57] ABSTRACT

In one preferred embodiment a two-part bracket assembly is provided for securing a downwardly sloping stringer to the upper of two building levels. Preferably, each part of the bracket is formed from a sheet of metal. One part of the bracket comprises a vertical flange which abuts against and is secured to the frame of the upper building level. A side panel of the bracket part lies in the vertical plane perpendicular to the plane of the flange and abuts against the side of the stringer. A flat support flange extends perpendicularly away from the lower edge of the side panel and extends underneath and abuts against the lower surface of the stringer. The plane of the support flange is angled downwardly relative to the vertical flange so that with the lower surface of the stringer abutting against the support flange, the stringer slopes downwardly from the upper building level. The second part of the bracket assembly is substantially a mirror image of the first part and is disposed on the opposite side of the stringer. Fasteners secure the vertical flange of the bracket assembly to the frame of the upper building level while like fasteners secure the side panel and support flange to the stringer.

In a second preferred embodiment only the first part of the bracket is used to secure the stringer to the vertical face of a support member.

14 Claims, 4 Drawing Figures

BRACKET ASSEMBLY

BACKGROUND OF THE INVENTION

I. Field of the Invention

The present invention relates generally to brackets and, more particularly, to a bracket adapted to secure the upper end of a downwardly sloping stringer to an upper building level.

II. Description of the Prior Art

In the construction of stairs for basements, outside sun decks, porches, and the like, it has been the previous practice to secure the upper end of a pair of spaced and parallel stringers to the upper building level so that the stringers slope downwardly from the upper to the lower building level. A plurality of flat steps are then constructed and secured to the stringers in any of a number of known fashions.

With this previously known stairwell construction, the stringers must be rigidly attached to the upper building level, such as an elevated outside sun deck. Since the stringers slope downwardly from the upper to the lower building level, the stringers must be accurately pre-cut in order to properly fit against the frame of the upper level while retaining parallelism between the spaced stringers. Such accuracy is difficult to obtain.

If the stringer is not accurately cut often it is discarded and a new stringer is cut. This procedure, results in a great deal of material wastage.

More often, inaccurately cut stringers are nevertheless used in the construction of the stairwell. While material wastage is avoided, the inaccurately cut stringers result in an unstable stairwell which may even collapse after extended use.

A still further disadvantage of the previously known stair construction with pre-cut stringers is that the attachment of the stringers to the frame of the upper building construction level is less rigid than desirable. As a result, after prolonged use, the stringers, due to the load upon the steps, loosen and begin to pull away from the frame of the upper building level. Periodic maintenance and reattachment of the stringers to the upper level frame is thus required. Such maintenance is not only bothersome but the stair construction may also prove to be dangerous in the event that the maintenance is not performed.

A still further disadvantage of the previously known stair construction is that the attachment of the stringer to the frame of the upper level is a difficult task. This problem is particularly prevalent where the stair construction is attached to an outdoor deck which is only slightly elevated. In such an event, the builder must position himself underneath the frame of the deck in order to attach the stringers.

SUMMARY OF THE PRESENT INVENTION

The present invention overcomes these above mentioned disadvantages in a stair construction by providing a simple bracket assembly for securing the upper end of a stringer to the frame of the upper of two vertically separated building levels.

In brief, in one preferred embodiment the stringer bracket of the present invention comprises a first and second part, both of which are integrally constructed of metal. The first part of the bracket includes a vertical flange portion which flatly abuts against the upper level frame. A side panel portion of the bracket part also lies in a vertical plane but is disposed substantially perpendicularly to the plane of the vertical flange so that the side panel flatly abuts against one side of the stringer. A lower support flange extends perpendicularly outwardly from the lower depending edge of the side panel and engages and abuts against the lower edge of the stringer. The plane of the support flange is angled or skewed relative to the plane of the vertical flange at the same angle that the stringer slopes downwardly from the upper building level.

The second part of the bracket is substantially a mirror image of the first part and is positioned so that its side panel abuts against the opposite side of the stringer.

Fasteners, such as nails or screws, secure both parts of the bracket assembly of the present invention to both the frame of the upper level and to the stringer thus rigidly securing the stringer in a downwardly sloping position from the upper building level.

The distance between the side panels of the bracket assembly is adjustable so that the bracket assembly is able to accommodate stringers of varying widths. Registering slots in the lower support flanges still permit fasteners to secure the support flanges to the stringer.

In a second preferred embodiment only the first part of the bracket is used to secure the stringer to the vertical face of a support member.

It can thus be seen that the present invention provides a simple and inexpensive means for securing a stringer in a downwardly sloping position from an upper building level which is not only simple but also sturdy in construction. Due to the simplicity of installation of the bracket assembly of the present invention, even the most inexperienced workmen are capable of accurately and rigidly constructing stairway stringers. Moreover, accurate parallelism between the stringers is assured despite an inaccurately constructed stringer.

BRIEF DESCRIPTION OF THE DRAWING

A better understanding of the present invention will be had upon reference to the following detailed description when read in conjunction with the accompanying drawing wherein like reference characters refer to like parts throughout the several views, and in which.

DETAILED DESCRIPTION OF THE PRESENT INVENTION

Figure 1:
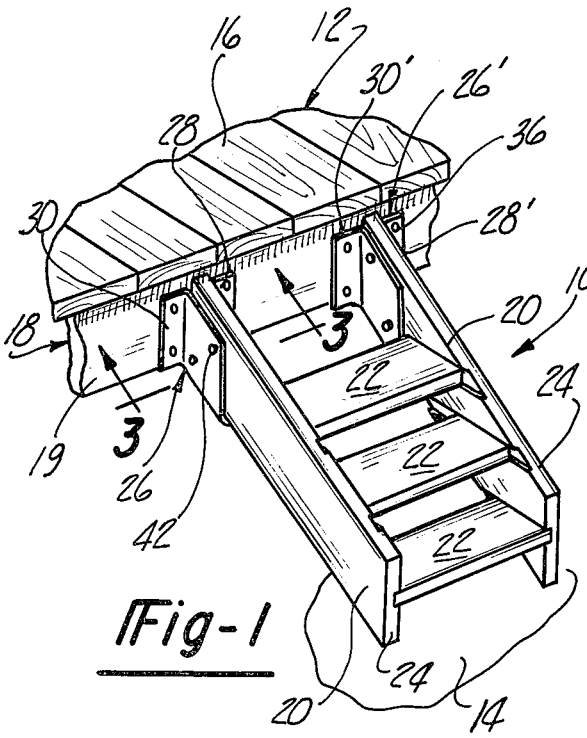
FIG. 1 is a fragmentary perspective view showing the bracket assembly of the present invention in a stair construction.

With reference first to FIG. 1, a stairway 10 is thereshown disposed between an upper building level 12 and a lower building level 14 so that the stairway 10 slopes downwardly from the upper to the lower level. The upper and lower levels 12 and 14 may comprise any conventional building construction, but, as shown, the upper level 12 is an outdoor deck having a floor 16 and a frame 18 supporting the floor 16 while the lower level 14 is a ground surface.

Still referring to FIG. 1 the stairway 10 further comprises a pair of spaced and parallel stringers 20 which slope downwardly from the frame 18 of the upper level 12 to the ground supporting surface 14. Each of the stringers 20 lies substantially in a vertical plane and a plurality of steps 22 are disposed between and are supported by the stringers 20.

Figure 3:
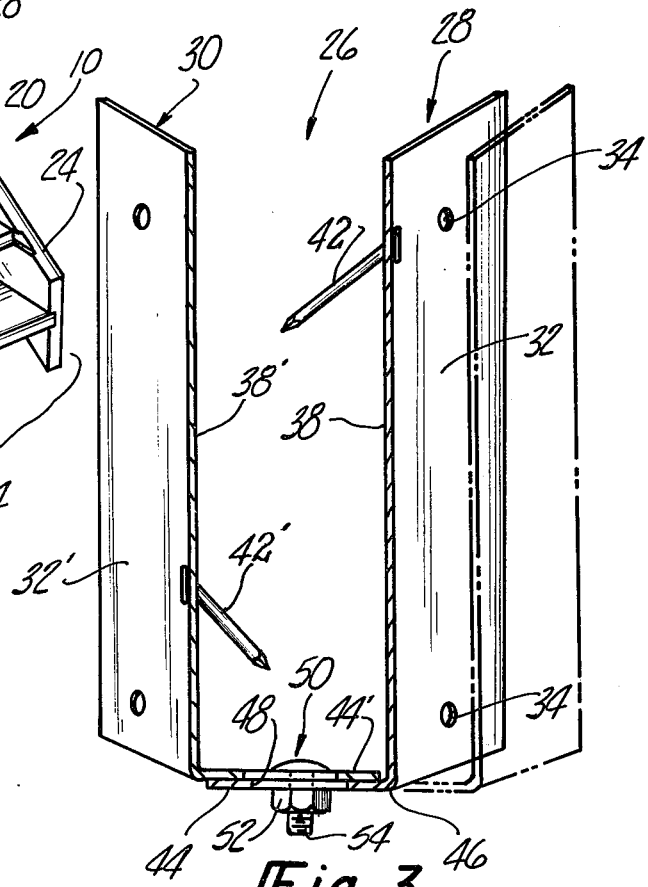
FIG. 3 is a cross-sectional view taken substantially along line 3—3 in FIG. 1 and enlarged for clarity.
Figure 2:
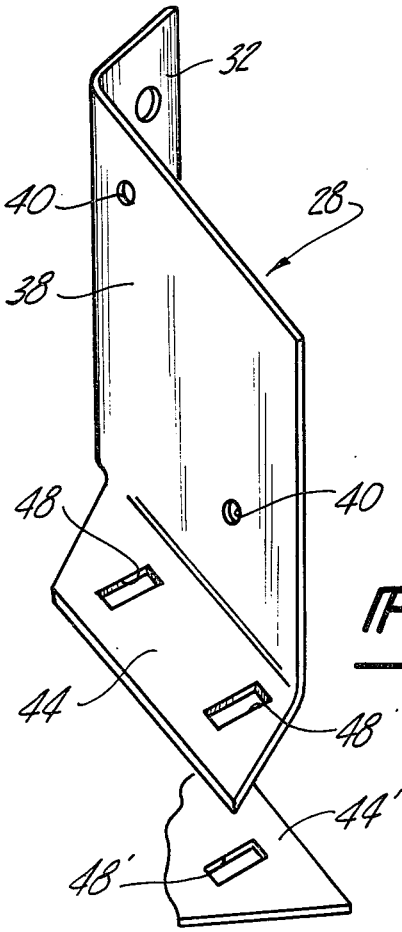
FIG. 2 is a partial fragmentary perspective view showing the bracket assembly of the present invention and enlarged for clarity.
Figure 4:
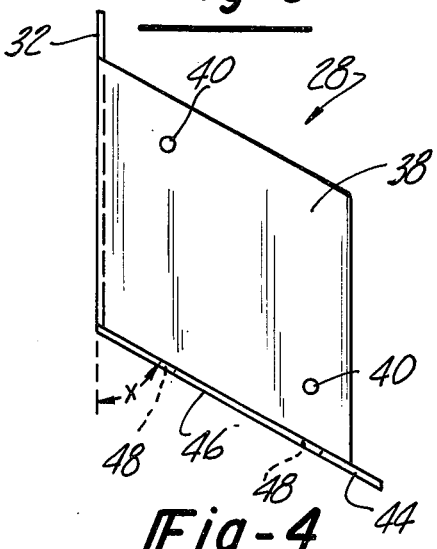
FIG. 4 is a side-plan view showing one part of the bracket assembly of the present invention.

The upper end of each stringer is secured by the bracket assembly 26 of the present invention to the upper level frame 18. Referring now to FIGS. 2 - 4, the bracket assembly 26 of the present invention is thereshown and comprises a first part 28 and a second part 30, each of which is preferably integrally formed of metal. The first and second parts 28 and 30 of the bracket assembly 26 are substantially mirror images of each other and, for the sake of brevity, only the first part 28 will be described in detail.

The first part 28 of the bracket assembly 26 includes a vertical support flange 32 (FIGS. 2, 3, 4) which lies substantially in a vertical plane and abuts against the side of a frame member 19 (FIG. 1) of the upper level frame 18. Apertures 34 through the support flange 32 receive fasteners 36 (FIG. 1), such as nails, therethrough, to secure the vertical support flange 32 flatly against and to the upper level frame 18.

The first part 28 of the bracket assembly 26 includes a side panel 38 which also lies in a vertical plane but extends substantially perpendicularly outwardly from the plane of the support flange 32. The side panel 38 abuts against one side of the stringer 20 and apertures 40 receive fasteners 42 therethrough, such as nails, to rigidly secure the side panel 38 flatly against and to the stringer 20.

A bottom support flange 44 extends perpendicularly outwardly from the lower depending edge 46 of the side panel 38 and abuts against and supports the lower surface of the stringer 20. The support flange 44 lies on the lateral side of the side panel 38 opposite the vertical support flange 32 to permit access to the vertical flange 32 with the bracket assembly 26 positioned on the upper level frame 18 (FIG. 1). Moreover, as best shown in FIG. 4, the plane of the support flange is skewed or angled relative to the vertical flange 32 by an acute angle "X." With the vertical flange 32 secured to the upper level frame 18, the angle "X" defines the angle of incline of the stringers 20 relative to the upper level 12, and consequently the inclination angle for the stairway 10. The support flange 44 includes a pair of spaced slots 48 elongated in a direction perpendicular to the plane of the side panel 38.

As previously described, the second part 30 of the stringer bracket 26 is substantially the mirror image of the first part 28 and, for the sake of brevity, will not be further described. In the drawing, however, the components of the second part 30 are differentiated by a prime mark (') following the reference characters.

With reference now particularly to FIG. 3, during the construction of the stairway 10, both parts 28 and 30 of the bracket assembly 26 are positioned on the upper level frame 18 so that the vertical support flanges 32 and 32' flatly abut against the frame 18 and with the side panels 38 and 38' in a substantially parallel relationship and abutting opposite sides of the stringer 20. In this position one of the lower support flanges 44, or 44' lies on top of the other such that the slots 48 and 48' are in registration. The two-part construction of the stringer bracket 26 thus permits a lateral adjustment, shown in phantom line in FIG. 3, between the side panels 38 and 38' so that the bracket assembly 26 may not only accommodate stringers having different widths, but will also compensate for variations of width in the commonly utilized stringer sizes. It will also be appreciated that a portion of the slots 48 and 48' remain in registration despite a lateral width adjustment of the parts 28 and 30.

With the first and second parts 28 and 30 properly spaced so that the side panels 38 and 38' flatly abut against the stringer 20, the vertical flanges 32 and 32' are secured to the upper level frame 18 by the fasteners 36 as has been already described. Fastening means 50, such as a nut 52 and a bolt 54 are disposed through the registering portions of the slots 48 and 48' to secure the lower support flanges 44 and 44' to each other. Alternatively, fasteners such as nails may be driven through the registering portion of the slots 48 and 48' and into the stringer 20. Lastly, fasteners are driven through the apertures 40 to secure the side panels 38 and 38' to the stringers 20.

It can thus be seen that the stringer bracket 26 of the present invention provides a simple, and inexpensive means for securing stringers between an upper of two building levels so that the stringers 20 slope downwardly from the upper to the lower level. Moreover, the novel lateral width adjustment of the stringer bracket permits a single bracket assembly 26 not only to be used with a variety of different width stringers, but also serves to compensate for width variations between different stringers of the same nominal construction width.

Additionally, it will be appreciated that the bracket assemblies 26 may be accurately manufactured so that the angle "X" remains substantially constant between different bracket assemblies 26. Accurate parallelism between the stringers 20 is therefore easily and automatically obtainable.

It has been found that in some installations the bracket members 28 and 30' or alternatively, 30 and 28', can be eliminated without effecting the strength of the assembly.

Having thus described my invention many modifications thereto will become apparent to those skilled in the art to which it pertains without deviation from the spirit of the invention as defined by the scope of the appended claims.

I claim:

1. A two-part bracket assembly adapted for securing a stringer for a stairway construction to the upper of two building levels so that said stringer slopes downwardly from the upper to the lower building level at a predetermined angle comprising:

a vertical flange on each of said parts disposed substantially in a vertical plane and abutting said upper building level, a side panel on each of said parts disposed substantially in a vertical plane and substantially perpendicular to the plane of the vertical flange whereby one panel is disposed on each side of said stringer, a support flange extending perpendicularly outwardly from the lower depending edge of each of said side panels and underneath said stringer wherein the plane of said support flange intersects the plane of said vertical flange at said predetermined angle, and each support flange includes registering slots adapted to receive a fastener therethrough, means for securing said vertical flanges to said upper building level so that the lower surface of said stringer abuts against at least one of said support flanges, and each of said two parts is substantially the mirror image construction of the other part.

2. The bracket assembly as defined in claim 1 wherein each part of said bracket assembly is integrally formed.

3. The bracket assembly as defined in claim 2 wherein each part of said bracket assembly is constructed of metal.

4. The bracket assembly as defined in claim 1 wherein said vertical flange and said support flange are on opposite lateral sides of said side panel for each of said parts.

5. The bracket assembly as defined in claim 1 and including means for securing said side panels to said stringer.

6. The bracket assembly as defined in claim 1 wherein one of said support flanges on one of said parts overlaps the other support flange on the other part.

7. A two-part bracket assembly comprising a first and a second bracket member and adapted for securing a pair of stringers for a stairway construction to the upper of two building levels so that said stringers slope downwardly from the upper to the lower building level at a predetermined angle comprising:

a vertical flange on each of said bracket members disposed substantially in a vertical plane and abutting said upper building level, a side panel on each of said bracket members disposed substantially in a vertical plane and substantially perpendicular to the plane of the vertical flange whereby the panel of said first bracket member is disposed on a side of one of said stringers and the panel of said second bracket is disposed on a side of the other of said stringers, a support flange extending perpendicularly outwardly from the lower depending edge of each of said side panels and underneath said stringers wherein the plane of said support flange intersects the plane of said vertical flange at said predetermined angle, and each support flange includes registering slots adapted to receive a fastener therethrough, means for securing said vertical flanges to said upper building level so that the lower surface of one of said stringers abuts against the support flange of said first bracket and the lower surface of the other of said stringers abuts against the support flange of said second bracket, and each of said two parts is substantially the mirror image construction of the other part.

8. The bracket assembly as defined in claim 7 wherein each bracket member of said bracket assembly is integrally formed.

9. The bracket assembly as defined in claim 8 wherein each bracket member is constructed of metal.

10. A bracket member for use in securing a stringer for a stairway construction to a vertical support surface on the upper of two building levels so that the stringer slopes downwardly from the upper to the lower building level at a predetermined obtuse angle, said bracket member comprising:

a side panel disposed in a substantially vertical plane and having a vertically extending edge, a flange extending from said edge in a plane substantially normal to the plane of said side panel, said flange abutting said vertical support surface, said side panel having a lower edge extending at an obtuse angle with respect to said vertically extending edge, said last mentioned obtuse angle corresponding to said predetermined obtuse angle, a support flange extending perpendicularly outwardly from said lower edge of said side panel and underneath said stringer whereby the plane of said support flange intersects the plane of said first-mentioned flange at said predetermined obtuse angle;

means for securing said first-mentioned flanges to said vertical support surface and means for securing said stringer to said support flange.

11. The invention as defined in claim 10 and including a second bracket member which is the mirror image of said first-mentioned bracket member.

12. A two-part bracket assembly adapted for securing a stringer for a stairway construction to the upper of two building levels so that said stringer slopes downwardly from the upper to the lower building level at a predetermined obtuse angle comprising:

a vertical flange on each of said parts disposed substantially in a vertical plane and abutting said upper building level, a side panel on each of said parts disposed substantially in a vertical plane and substantially perpendicular to the plane of the vertical flange whereby one panel is disposed on each side of said stringer, a support flange extending perpendicularly outwardly from the lower depending edge of each of said side panels and underneath said stringer, the plane of said support flange intersecting the plane of said vertical flange at said predetermined obtuse angle, and means for securing said vertical flanges to said upper building level so that the lower surface of said stringer abuts against at least one of said support flanges.

13. The bracket assembly as defined in claim 12 wherein each part is substantially the mirror image of the other part.

14. The bracket assembly as defined in claim 12 and including registering slots in each of said support flanges adapted to receive a fastener therethrough.

* * * * *